US006905345B2

(12) United States Patent
Zhang

(10) Patent No.: US 6,905,345 B2
(45) Date of Patent: Jun. 14, 2005

(54) ELECTRICAL CONNECTOR ASSEMBLY

(75) Inventor: Chi Zhang, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/936,281

(22) Filed: Sep. 7, 2004

(65) Prior Publication Data

US 2005/0042898 A1 Feb. 24, 2005

(30) Foreign Application Priority Data

Sep. 6, 2003 (CN) ..... 03278411 U

(51) Int. Cl.[7] ..... H01R 9/09
(52) U.S. Cl. ..... 439/74
(58) Field of Search ..... 439/65, 66, 74, 439/83, 660

(56) References Cited

U.S. PATENT DOCUMENTS 5,116,247 A 5/1992 Enomoto et al.
5,921,787 A * 7/1999 Pope et al. ..... 439/74
6,019,613 A * 2/2000 Kataoka et al. ..... 439/83
6,132,258 A 10/2000 Kajinuma
6,338,630 B1 1/2002 Dong
6,471,539 B1 * 10/2002 Yu ..... 439/489
6,485,312 B1 11/2002 Yu
6,645,005 B2 * 11/2003 Wu ..... 439/563

* cited by examiner

*Primary Examiner*—Thanh-Tam Le
(74) *Attorney, Agent, or Firm*—Wei Te Chung

(57) ABSTRACT

An electrical connector assembly for connecting one printed circuit board to another printed circuit board comprises a first connector (1) and a second connector (2). The first connector includes a first insulative housing (10) and a number of first terminals (11). The first insulative housing has an elongate central island (103) with a recess (104) therein, and comprising a number of apertures (101). The first terminals are received in corresponding apertures. The second connector includes a second insulative housing (20) and a number of second terminals (21). The second insulative housing has a tongue portion (201) mating with the recess of the first housing. When the first connector mates with the second connector, the second terminals electrically connect with the first terminals by extending into the apertures respectively.

3 Claims, 6 Drawing Sheets

ELECTRICAL CONNECTOR ASSEMBLY

BACKGROUND OF THE INVENTION

1. Field of the Invention

The present invention generally relates to an electrical connector assembly, and more particularly to an electrical connector assembly for being mounted on two printed circuit boards.

2. Description of Related Art

Board to board electrical connector assembly, consisting of two electrical connectors mounted on nearly parallel printed circuit boards to be connected together, is known in the art. Generally, connector assembly is used for signal transmission between two printed circuit boards.

A connector assembly disclosed in U.S. Pat. No. 6,338,630 comprises matable first and second connectors. The first connector comprises a first insulative housing and a plurality of first terminals received in the first housing. The first housing includes a mating portion and a central island extending upwardly from a base portion of the first housing. The first terminals are retained in the central island, and the contact portions of the first terminals are exposed in a receiving space formed in the first housing. The second connector includes a second housing and a plurality of second terminals received in the second housing. The second housing comprises a coupling portion, and the second terminals are secured in the coupling portion. When the first connector mates with the second connector, the central island of the first connector is received in the coupling portion of the second housing. Meanwhile, the first terminals connect with the second terminals. The contact portions of the first terminals expose in the receiving space and are easy to be destroyed when the first connector mates with the second connector or they are pressed by unexpected external force. When the resiliency of the first terminals reduces, the first terminals withdraw into the mating portion, thereby resulting in ill electrical connection between the two connectors. Furthermore, insulative housings of electrical connectors are easy to be deformed. After connecting or disconnecting with each other several times, electrical terminals received in the housing correspondingly offset from its correct positions such the normal force between certain first terminals of the first connector and the second terminals of the second connector may become insufficient when the first connector and the second connector are mated. As a result, a reliable electrical connection between the first connector and the second connector cannot be assured.

Hence, an improved connection-reliability connector assembly is highly desired to overcome the disadvantages of the prior art.

SUMMARY OF THE INVENTION

Accordingly, an object of the present invention is to provide an electrical connector assembly, which can improve normal force between two connectors thereof.

In order to achieve the object set forth, an electrical connector assembly in accordance with the present invention comprises a first connector and a second connector matable with the first connector. The first connector includes a first housing and a plurality of first terminals. The first housing comprises a central island defining a groove and a plurality of apertures. The first terminals are respectively retained in corresponding apertures. The second connector comprises a second insulative housing and a plurality of second terminals. The second housing has an elongate tongue portion mating with the groove of the first housing of the first connector. When the first connector connects with the second connector, the second terminals extend into the corresponding apertures and electrically connect with the first terminals. Accordingly, a stable and reliable electrical connection between the first connector and the second connector is established.

Other objects, advantages and novel features of the present invention will be drawn from the following detailed description of a preferred embodiment of the present invention with attached drawings, in which:

DETAILED DESCRIPTION OF THE INVENTION

Reference will now be made in detail to the preferred embodiment of the present invention.

Figure 1:
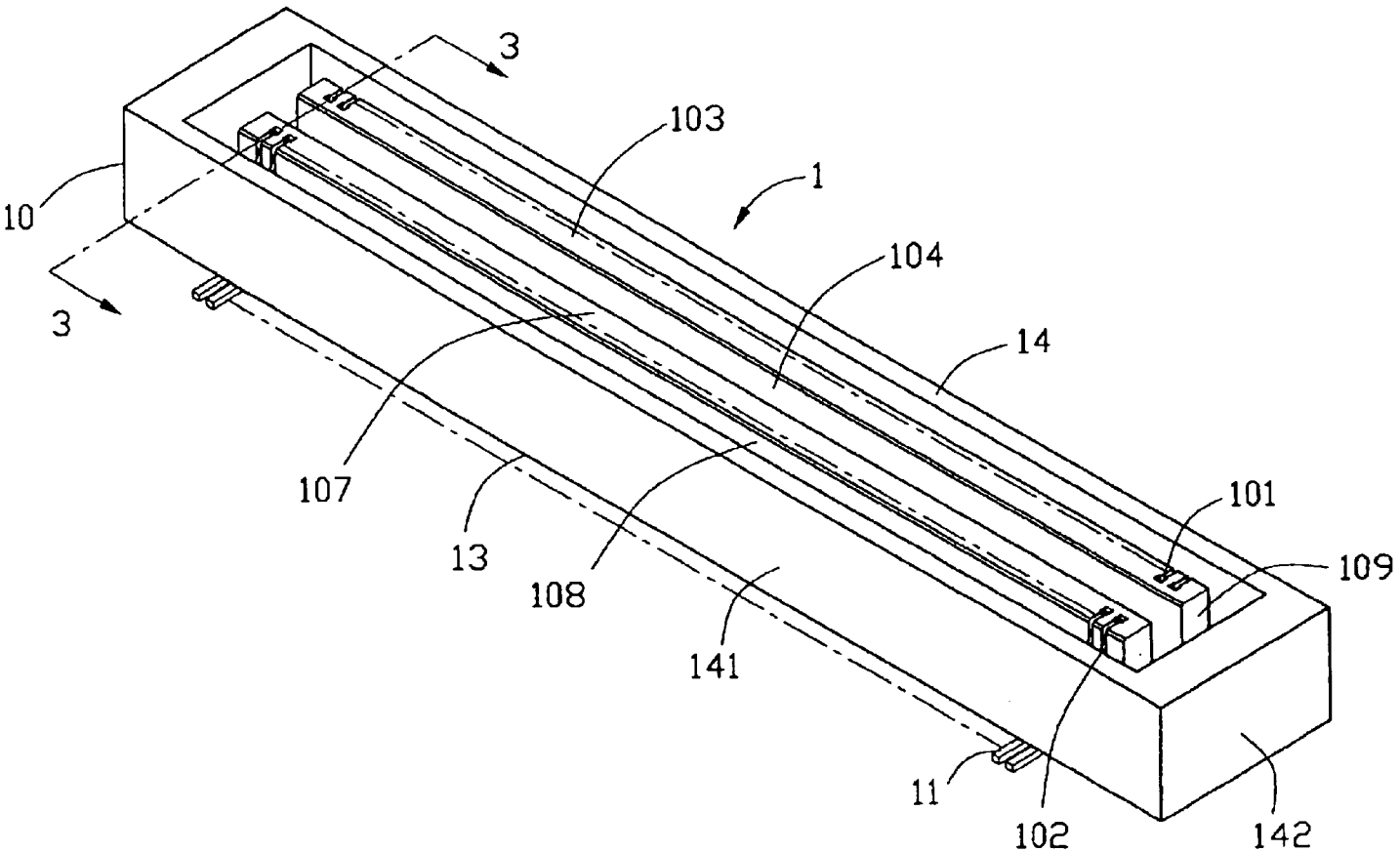
FIG. 1 is perspective view of a first connector of an electrical connector assembly in accordance with the present invention.
Figure 2:
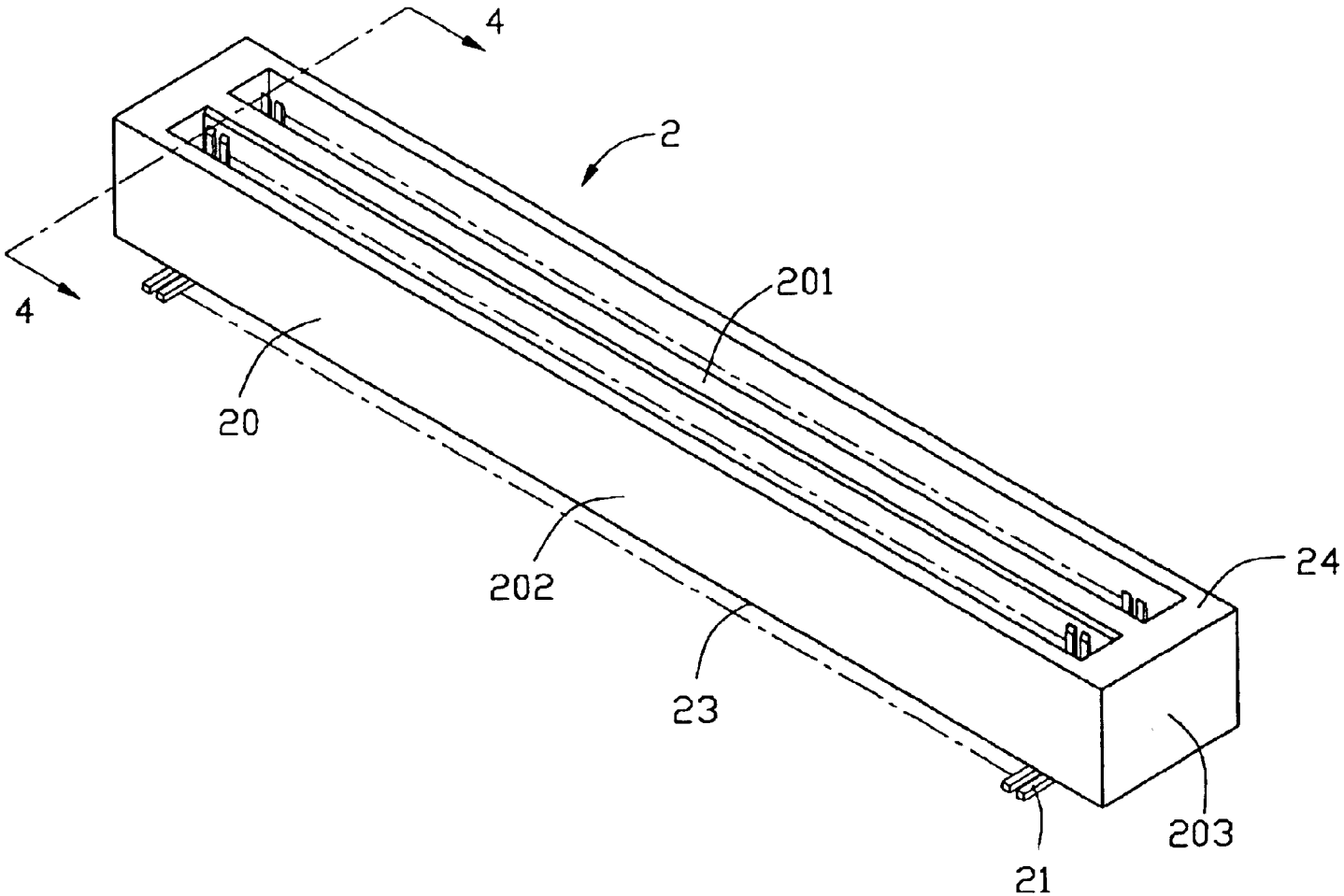
FIG. 2 is perspective view of a second connector of the electrical connector assembly in accordance with the present invention.

Referring to FIG. 1 and FIG. 2, an electrical connector assembly consists of a first connector 1 and a second connector 2 matable with the first connector 1.

Figure 3:
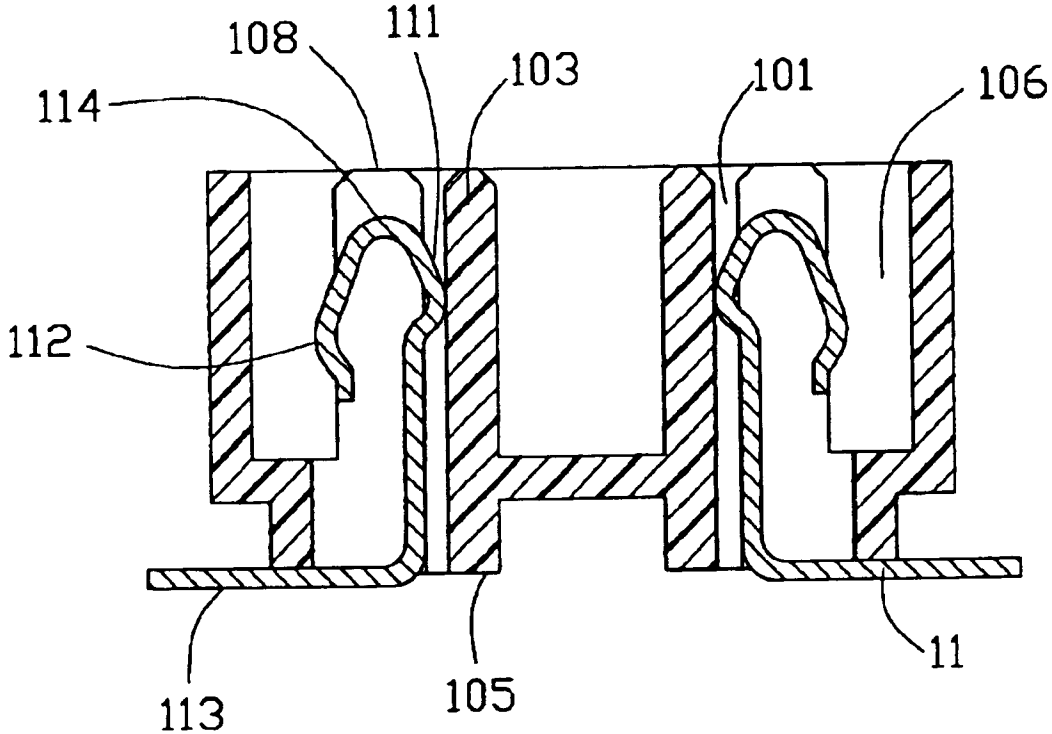
FIG. 3 is a cross-sectional view of the first connector, taken along line 3—3 in FIG. 1.

Referring to FIG. 1 and FIG. 3, the first connector 1 includes an elongate first insulative housing 10 and a plurality of first terminals 11. The first housing 10 includes a base 13 and a first mating portion 14 extending upwardly from the base 13. The first mating portion 14 comprises a pair of opposite longitudinal walls 141, a pair of opposite lateral walls 142 and formed a receiving space 106 between the longitudinal wall 141 and lateral walls 142. In the center of the receiving space 106, a central island 103 extends upwardly from the first base 13. The central island 103 comprises a top surface 107, a pair of side surfaces 108, a pair of end surfaces 109, and a recess 104 defined therein. A plurality of terminal passageways 102 are defined in opposite side surfaces 108 thereof. Two rows of apertures 101 extend downwardly from the top surface 107 and communicate with the corresponding terminal passageways 102.

Each of the first terminals 11 has a connect portion 113 for mounting to the printed circuit boards, a first contact portion 111 extending upwardly from the end of connect portion 113, a second contact portion 112 of the first terminals 11 opposite with the first contact portion 111 and a bent portion 114 formed between the first contact portion 111 and the second contact portion 112.

In assembling the first connector 1, the first terminals 11 are mounted from the bottom into the first housing 10. The bent portion 114 and the second contact portion 112 of the first terminals 11 are respectively retained in the corresponding terminal passageways 102. At the same time, the first contact portions 111 of the first terminals 11 are respectively retained in the apertures 101. The second contact portions 112 partially protrude into the receiving space 106. The portions between the first contact portions 111 and the connect portions 113 are retained in the first housing 10. The connect portion 113 of the first terminals 11 extend horizontally out of the first housing 10.

Figure 4:
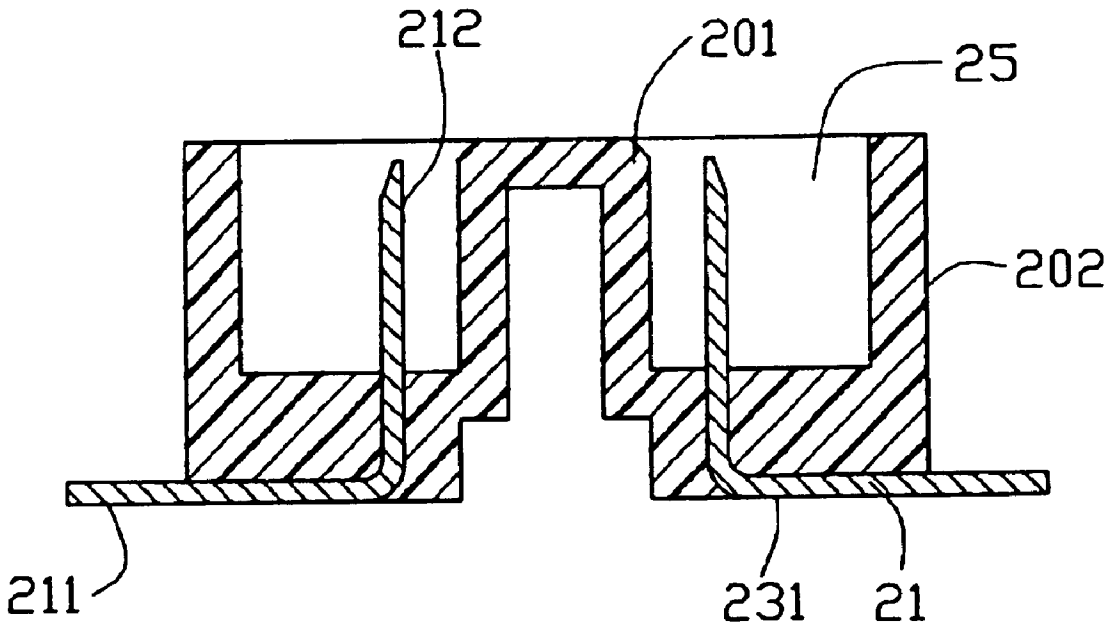
FIG. 4 is a cross-sectional view of the second connector, taken along line 4—4 in FIG. 2.

Referring to FIG. 2 and FIG. 4, the second connector 2 includes a second insulative housing 20 and a plurality of second terminals 21 received in the second housing 20. The second housing 20 comprises a second base 23 and a second mating portion 24 extending from the second base 23. The second mating portion 24 comprises a pair of opposite longitudinal walls 202, a pair of opposite lateral walls 203, and a receiving space 25 between the longitudinal walls 202 and the lateral walls 203. At the center of the receiving space 25, a tongue portion 201 extends upwardly from the second base 23. A plurality of passageways 231 are defined in the second base 23 of the second housing 20 for correspondingly receiving the second terminals 21. The passageways 231 are arranged in two rows at both sides of the tongue portion 201. The second terminals 21 each include a connect portion 211 and a contact portion 212 extending upwardly from the connect portion 211.

In assembling the second connector 2, the second terminals 21 are mounted into the second housing 20 from the second base 23 of the second housing 20. The connect portions 211 of the second terminals 21 extend horizontally out of the second housing 20 and the contact portions 212 of the second terminals 21 extend upwardly from the passageways 231 into the receiving space 25.

Figure 5:
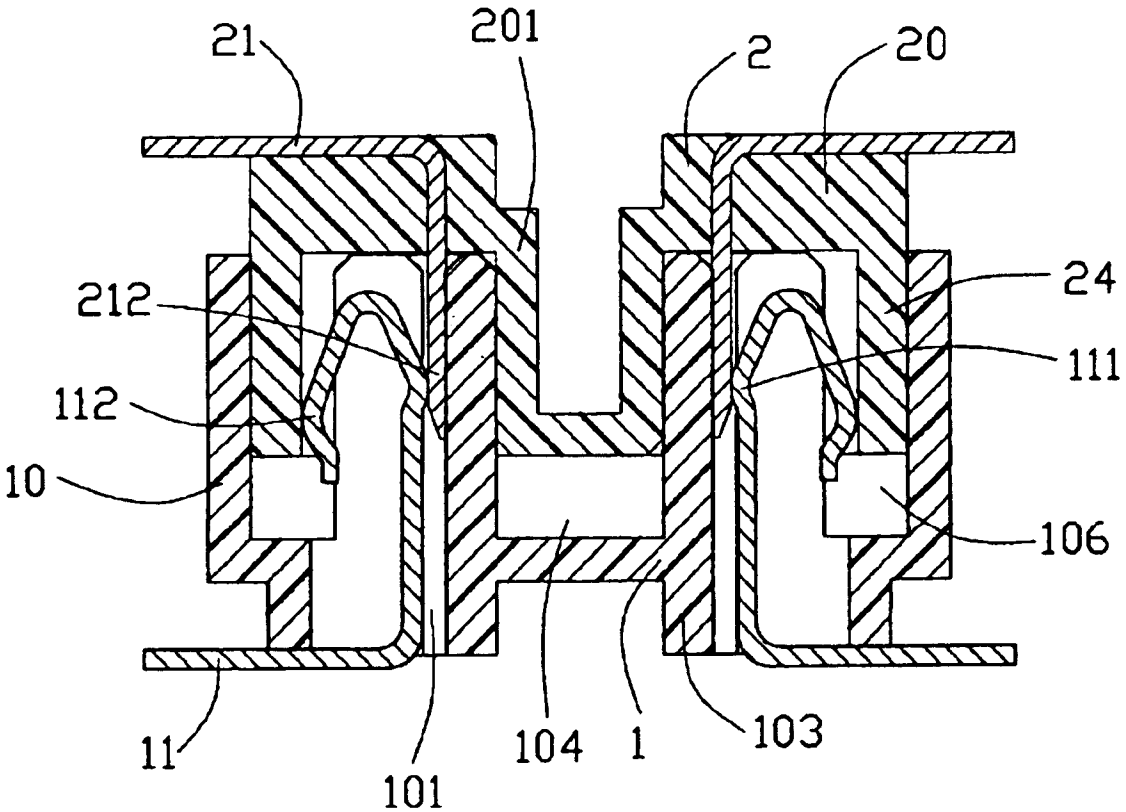
FIG. 5 is a cross-sectional view of the first connector and the second connector mating with the first connector.

Referring to FIG. 5, when the first connector 1 mates with the second connector 2, the second mating portion 24 of the second connector 2 is received in the receiving space 106 of the first connector 2. The tongue portion 201 extends into the recess 104 of the central island 103 of the first connector 1. The contact portion 212 of the second terminals 21 extends into the aperture 101 of the central island 103 of the first housing 10 and electrically connects with the first contact portion 111 of the first terminals 11. The side walls 202 of the second connector 2 engage with the second contact portion 112 of the first terminals 11. As a result, the retention force between the first terminals 11 and the second terminals 21 is improved, and the stable and reliable electrical connection is accordingly established.

Figure 6:
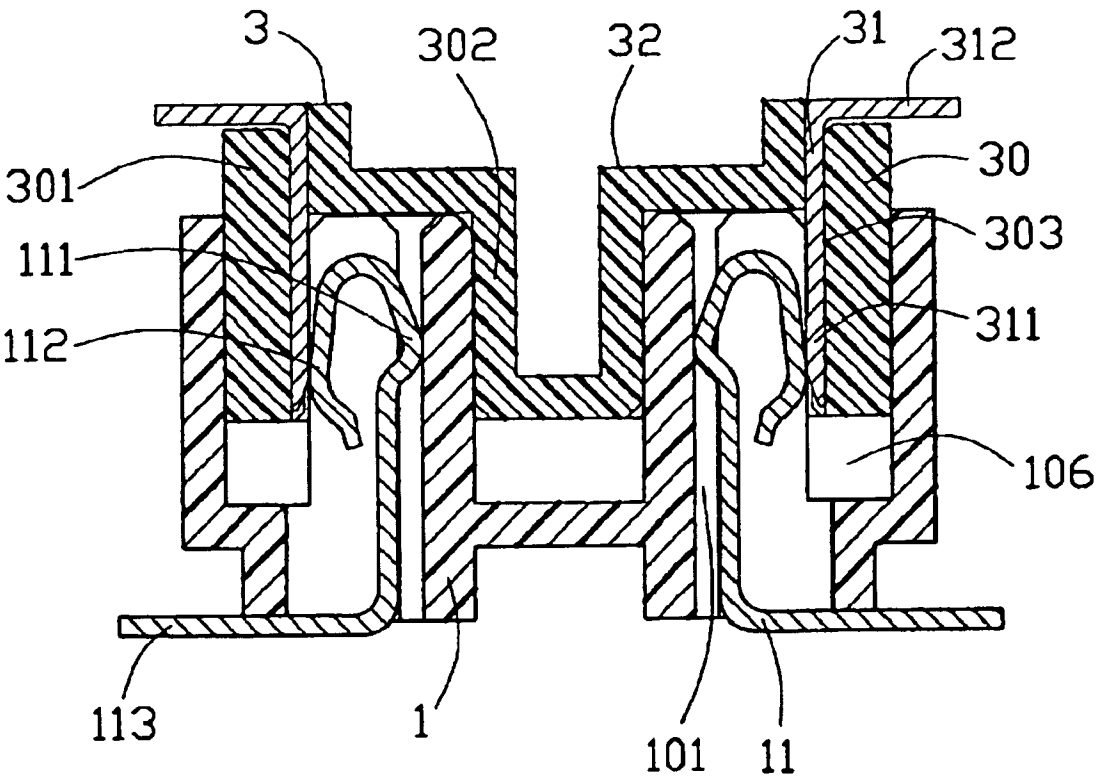
FIG. 6 is a cross-sectional view of the first connector mating with a conventional complementary connector.

Referring to FIG. 6, the first connector 1 in accordance with the present invention mates with another type of connector called third connector 3. The third connector 3 includes a third insulative housing 30 and a plurality of third terminals 31. The third housing 30 comprises a third base 32 and a pair of opposite side walls 301 defined a plurality of passageways 303 thereof. The passageways 303 are used for receiving corresponding third terminals 31 therein. At the center of the third base 32, an elongate tongue 302 for mating with the recess 104 of the central island 103 of the first connector 1 is formed. The third terminals 31 each comprise a connect portion 312 for connecting onto printed circuit board (not shown) and a contact portion 311 extending from the connect portion 312. When the first connector 1 connects with the third connector 3, the side walls 301 of the third connector 3 are received into the receiving space 106. The elongate tongue 302 extends into the recess 104 of the central island 103 of the first connector 1. Accordingly, the contact portion 311 of the third terminals 31 secured in the side walls 301 of the third connector 3 electrically connects with the second contact portion 112 of the first terminals 11. The first contact portion 111 of the first terminals 11 engage with the inner wall of the apertures 101 of the first connector 1. As a result, the retention force between the first terminals 11 and the third terminals 31 is improved, and accordingly the stable and reliable electrical connection there between is also established.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly adapted for mounting on two printed circuit boards, comprising:

a first connector comprising an elongate first insulative housing and a plurality of first terminals, the first insulative housing comprising a central island defining a recess and a plurality of apertures therein, each of said first terminals comprising a first contact portion and a second contact portion, the first contact portions being respectively retained in said apertures, while the second contact portion protruding out of the central island; and a second connector comprising a second insulative housing and a plurality of second terminals, the second insulative housing comprising a tongue portion mating with the recess of the first insulative housing, the second terminals extending into corresponding apertures to electrically connect with the first terminals via said first contact portion;

wherein the apertures extend downwardly from a top surface of the central island of the first connector; wherein the central island defines a plurality of passageways for retaining the first terminals; and wherein the passageways are in communication with the apertures.

2. The electrical connector assembly as claimed in claim 1, wherein the apertures of the first insulative housing are arranged in two rows.

3. The electrical connector assembly as claimed in claim 1, wherein each of the first terminals comprises a connect portion extending downwardly from the first contact portion and out of the first insulative housing.

* * * * *